United States Patent [19]

Yamada

[11] Patent Number: 4,492,395

[45] Date of Patent: Jan. 8, 1985

[54] AUTOMOTIVE DOOR LATCH SYSTEM INCLUDING A CHILDPROOFING MECHANISM

[75] Inventor: Shinjiro Yamada, Tokyo, Japan

[73] Assignee: Mitsui Kinzoku Kogyo K.K., Tokyo, Japan

[21] Appl. No.: 404,524

[22] Filed: Aug. 2, 1982

[30] Foreign Application Priority Data

Aug. 7, 1981 [JP] Japan ..... 56-122922
Aug. 7, 1981 [JP] Japan ..... 56-122923

[51] Int. Cl.[3] ..... E05C 3/06

[52] U.S. Cl. ..... 292/216; 292/DIG. 27; 292/DIG. 65

[58] Field of Search ..... 292/216, 280, DIG. 27, 292/DIG. 23, DIG. 65

[56] References Cited

U.S. PATENT DOCUMENTS

| | | | |
|---|---|---|---|
| 2,877,043 | 3/1959 | Leslie | 292/280 |
| 2,904,365 | 9/1959 | Cockburn et al. | 292/DIG. 27 X |
| 2,940,788 | 6/1960 | Thorne | 292/280 X |
| 3,140,888 | 7/1964 | Di Salvo | 292/DIG. 27 X |
| 3,649,061 | 3/1972 | Meyer | 292/DIG. 27 X |
| 3,697,105 | 10/1972 | Marx | 292/DIG. 27 X |
| 4,076,301 | 2/1978 | Gergoe | 292/216 X |
| 4,334,704 | 6/1982 | Yamada | 292/216 |

FOREIGN PATENT DOCUMENTS

| | | | |
|---|---|---|---|
| 35918 | 3/1979 | Japan | 292/DIG. 65 X |

*Primary Examiner*—Alexander Grosz
*Assistant Examiner*—Russell W. Illich
*Attorney, Agent, or Firm*—Fitzpatrick, Cella, Harper & Scinto

[57] ABSTRACT

A latch member or rotor is rotatably mounted in a main body or frame, attached to a vehicle door, for engaging a striker affixed to the vehicle body. Also mounted in the main body, in coplanar relation to the latch member, is a ratchet engageable with the latter to inhibit its motion in a direction to disengage the striker. The main body has an upstanding bracket on which three levers are mounted for pivotal motion about a common axis, in planes perpendicular to the plane of the latch member and the ratchet. The three levers are: (1) an actuating lever acting directly on the ratchet to cause the same to disengage the latch member and hence to unlatch the door; (2) an outside release lever linked to an outside door handle; and (3) an inside release lever linked to an inside door handle. These levers are interrelated in such a manner that the latch member releases the striker upon actuation of either the outside or the inside door handle. The invention further comprises, as incidental features, a locking mechanism for making the actuating lever unresponsive to the actuation of both outside and inside door handles, and a childproofing mechanism for making the actuating lever unresponsive to the actuation of only the inside door handle.

8 Claims, 15 Drawing Figures

84
81
85
89
91
73
42
40
61
60
60a
63
64
66
60b
80
41
96
70
71
68
69
75
50
87
47
52
49
51
83
82
90
1
53
57
58
56b
54
56
56a
59
61
48

AUTOMOTIVE DOOR LATCH SYSTEM INCLUDING A CHILDPROOFING MECHANISM

BACKGROUND OF THE INVENTION

The present invention pertains to a door latch system, particularly for the side doors of motor vehicles, more particularly for those of passenger cars.

Passenger car side door latch systems in general comprise a latch assembly on a door and a striker on the opposing member of the vehicle body. As heretofore constructed, the latch assembly typically comprises: (1) a latch member (or rotor) engageable with the striker upon closure of the door; (2) a ratchet for restraining the latch member from rotation in a direction to release the striker; (3) a release lever for causing the ratchet to disengage the latch member; and (4) a locking lever for preventing the release lever from acting on the ratchet and hence for locking the door against accidental or undesired opening. All of these components of the latch assembly move in parallel planes, and some of them in coplanar relation to each other, in accordance with the prior art.

One of the objections to this known type of latch system concerns the linkages for operating the latch assembly from within the vehicle. The release lever is actuated from both outside.and inside handles on the vehicle door, whereas the locking lever is actuated from a knob on the window sill of the door. The linkage between the inside handle and the release lever, and the linkage between the knob and the locking lever, both move in planes normal to the planes of the listed components of the latch assembly. Inevitably, therefore, undesirable three-dimensional power transfers are required from the final elements of the linkages to the release and locking levers, as will be later explained in more detail with reference to the drawings attached hereto.

Another objection to the prior art is the arrangement of the latch components. In the prior art system the main body or frame of the latch assembly essentially houses only the latch member and the ratchet. The release lever, the locking lever, and the other associated means are mounted externally on the body, in parallel relation to the latch member and the ratchet. In addition to these, the body must externally support the noted final elements of the linkages in an upstanding attitude. Thus the configuration of the parts on the outside of the body is complex and unorderly and makes difficult the manufacture and assemblage of the device.

A further problem manifests itself in conjunction with the latch systems on the rear doors of four-door passenger cars. While the latch systems on the front and rear doors are essentially identical, the designs of four-door passenger cars often require the latch assemblies on the rear doors to be oriented out of the perpendicular. This orientation of the latch assemblies has heretofore incurred considerable losses in power transmission from the outside handles.

An additional problem resides in the mechanism for making the latch system "childproof", that is, unopenable by children tampering with the inside handle. Since the conventional latch assembly itself is very complex in construction as discussed hereinbefore, the addition of the childproofing mechanism has rendered it still more so.

SUMMARY OF THE INVENTION

This invention seeks to make the door latch system, particularly the latch assembly, materially simpler, more compact, and more streamlined in the arrangement of the working parts than hitherto. In attaining this objective, moreover, the invention also seeks to make easier the manufacture and assemblage of the device. It further seeks to incorporate into the system a childproofing mechanism without any major alteration of the existing parts and without complicating the overall configuration to any appreciable degree.

Stated broadly, the invention provides an automotive door latch system comprising a striker to be attached to a vehicle body, and a main body to be attached to a vehicle door, with the main body having a guideway for receiving the striker upon closure of the door. Mounted in the main body in coplanar relation to each other are a latch member for engaging the striker in the guideway in order to hold the door closed, and a ratchet engageable with the latch member to inhibit its motion in a direction to disengage the striker. The main body has on its back an upstanding bracket oriented at right angles with the plane of the latch member and the ratchet. On this upstanding bracket there are mounted lever means generally pivotable in a plane parallel thereto and, in consequence, normal to the plane of the latch member and the ratchet. Operatively linked to both outside and inside handles on the vehicle door, the lever means act on the ratchet to cause the same to disengage the latch member in response to the manipulation of either handle.

Preferably, the lever means comprise three levers pivoting coaxially in parallel planes. These are: (1) an actuating lever for acting directly on the ratchet; (2) an outside release lever linked to the outside handle and operatively coupled to the actuating lever; and (3) an inside release lever linked to the inside handle and normally in abutting contact with the outside release lever. The actuating lever is normally pivoted by both the outside and the inside release levers for movement into abutting engagement with the ratchet, causing the same to disengage the latch member.

The invention particularly features the mounting, on the common bracket, of all the three levers required for the actuation of the ratchet. The main body of the latch assembly has only the latch member and the ratchet mounted therein. For assemblage, therefore, the three levers may first be mounted in place on the bracket, and then the bracket may simply be attached to the main body, there being no mechanical connection between the actuating lever and the ratchet. The assemblage is made even easier by the coaxial mounting of the three levers.

The above explained arrangement of the parts require three-dimensional power transfer only at one point, so that the linkages including the levers are more stabilized dynamically than their conventional counterparts. The arrangement as a whole is well streamlined, compact, and does not necessitate too much accuracy in machining and assemblage. It is also an advantage that no loss is involved in power transmission from the outside handle to the outside release lever.

Additional features of the invention reside in a mechanism for locking the door in the closed position against manipulation of both outside and inside handles, and a mechanism for childproofing the latch system. The invention admits of easy addition of these mechanisms to the latch system. The door can be locked simply by holding the actuating lever stationary in spite of the pivotal motion of the outside and inside release levers, and the latch system can be made childproof by holding at least the actuating lever stationary in spite of the pivotal motion of the inside release lever.

The above and other features and advantages of this invention and the manner of attaining them will become more apparent, and the invention itself will best be understood, from a study of the following description taken together with the attached drawings.

DETAILED DESCRIPTION OF THE INVENTION

Figure 1:
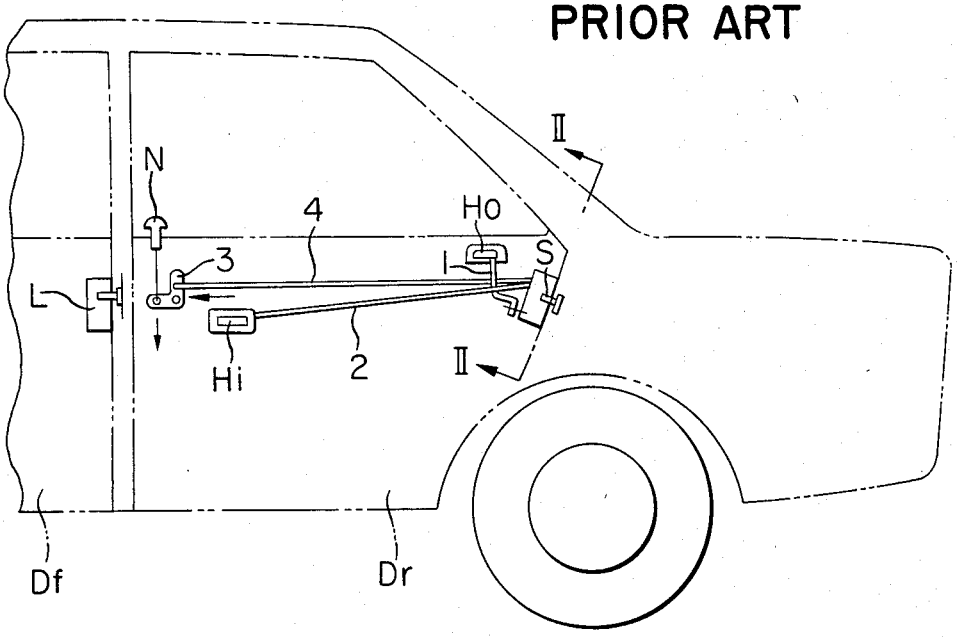
FIG. 1 PRIOR ART
FIG. 1 is a fragmentary, diagrammatic side elevation of a typical four-door passenger car, showing in particular the arrangement of the components of a prior art latch system for each rear door of the vehicle.

It is considered essential that the prior art vehicle door latch system be shown and described in some more detail, the better to make clear the features and advantages of the instant invention. FIG. 1 is a schematic representation of a typical four-door passenger car, having front doors Df and rear doors Dr. Each door has its own latch system including a latch assembly L. Each latch assembly is operated both from without the vehicle, by an outside handle on the door, and from within the vehicle, by an inside handle on the door and by a locking knob on the sill of the door window.

Figure 2:
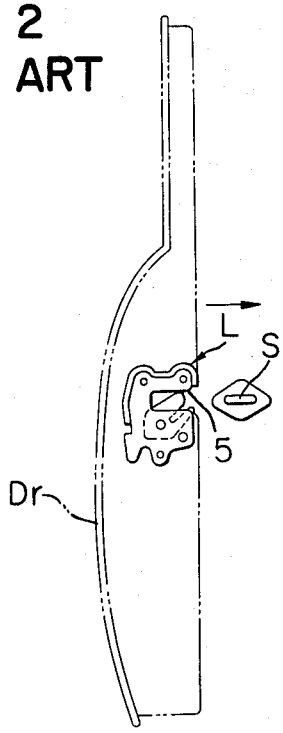
FIG. 2 PRIOR ART
FIG. 2 is an enlarged end view of one of the rear doors of the vehicle, as seen in the direction of the arrows II in FIG. 1, showing in particular the latch assembly on the door together with the striker for engagement therewith.

Take, for example, the latch system on the illustrated rear door Dr of the vehicle. The latch assembly L of this system is operatively coupled to the outside handle Ho via a link 1, to the inside handle Hi via a link 2, and to the sill knob N via a bell crank 3 and a link 4. As better shown in FIG. 2, the latch assembly L is attached to the end face of the rear door Dr and coacts with a striker S on the opposing member of the vehicle body to hold the door in a closed position relative to the body. Indicated by the reference numeral 5 in this figure is a guideway in the latch assembly L for receiving the striker S when the door is closed.

A particular problem arises with the conventional latch systems on the rear doors of vehicles. Car designs frequently require the latch assemblies, as well as the associated strikers, to be oriented at an angle to the perpendicular, as shown in FIG. 1 and in greater detail in FIG. 3. The problem will become apparent in the course of the following continued description of the prior art.

Figure 3:
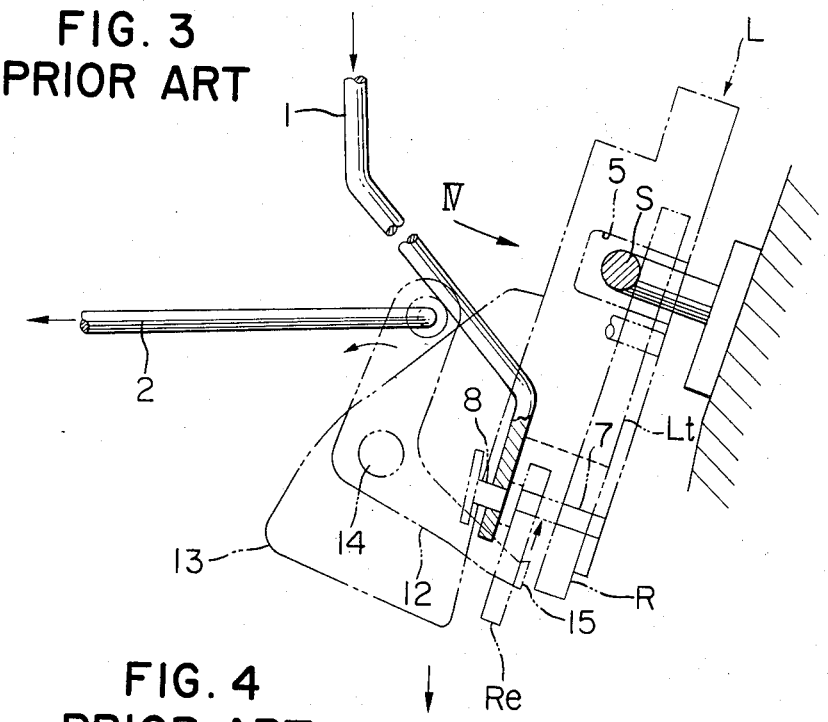
FIG. 3 PRIOR ART
FIG. 3 is a fragmentary, diagrammatic side elevation, partly sectioned for illustrative convenience, of the prior art latch system.
Figure 4:
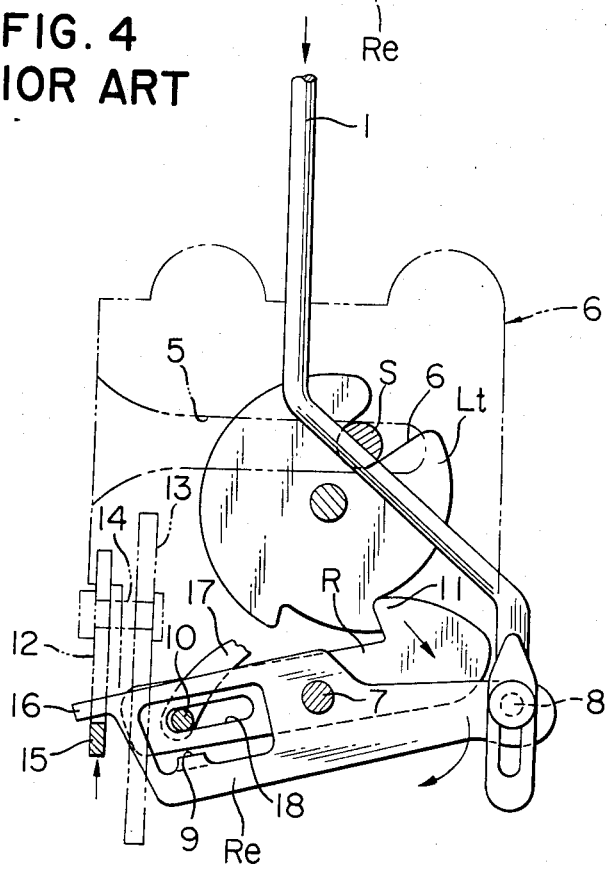
FIG. 4 PRIOR ART
FIG. 4 is a fragmentary, diagrammatic rear elevation, partly sectioned for illustrative convenience, of the prior art latch system as seen in the direction of the arrow IV in FIG. 3.

While both FIGS. 3 and 4 illustrate the details of the conventional latch assembly L and associated means, the latter figure more aptly reveals its internal configuration. Labeled Lt in these figures is a latch member or rotor rotatably mounted across the striker guideway 5. The latch member Lt is recessed at 6 to engage the striker S in the guideway 5 and hence to restrain the vehicle door to the vehicle body. In order to retain the latch member Lt in engagement with the striker S, a ratchet R is medially supported by a pivot pin 7, on which there is likewise mounted a release lever Re acting on the ratchet to cause disengagement of the latch member from the striker. One end of the release lever Re is pin-jointed at 8 to the link 1 leading to the outside handle Ho. Formed at or adjacent the other end of the release lever Re is a pusher 9 movable into and out of abutment against a pin 10 slidably engaged in a slot 18 in the ratchet R.

Thus, upon manipulation of the outside handle Ho, the release lever Re turns in the clockwise direction, as viewed in FIG. 4, about the pivot pin 7. If then the pin 10 is lying in the illustrated position in the ratchet slot 18, the pusher 9 of the release lever Re moves into abutment against this pin and further pivots the ratchet R clockwise, resulting in the disengagement of its pawl 11 from one of the notches in the latch member Lt. Thus disengaged from the ratchet R, the latch member Lt becomes free to turn in the direction to release the striker S.

The following means are provided, in accordance with the prior art, to unlatch the door in response to the activation of the inside handle Hi. As seen in both FIGS. 3 and 4, a bell crank 12 is pivotally pinned at 14 on an upstanding bracket 13 on the main body or frame of the latch assembly L. The bell crank 12 has one of its arms pin-jointed to the link 2 leading to the inside handle Hi. The other arm of the bell crank has its distal end 15 held opposite to an extension 16 of the release lever Re serving as an abutment. The actuation of the inside handle Hi causes the endwise motion of the link 2, toward the left as viewed in FIG. 3, resulting in the counterclockwise turn of the bell crank 12. Thereupon the end 15 of the bell crank moves into contact with the release lever extension 16 and further pivots the release lever in the clockwise direction as seen in FIG. 4. Thus the latch member Lt releases the striker S just as in the case of the manipulation of the outside handle Ho.

As is clear from the foregoing, the prior art latch system requires the link 1 leading to the outside handle Ho and the bell crank 12 coupled to the inside handle Hi, for the actuation of the release lever Re. Because of the very configuration of the latch system, the bell crank 12 must pivot in a plane at right angles with the plane of the release lever Re. This necessitates, of course, three-dimensional power transfer from the bell crank 12 to the release lever Re.

A similar problem arises with the locking mechanism incorporated in this conventional door latch system. The locking mechanism includes a link 17 (FIG. 4) carrying the aforesaid pin 10 slidably engaged in the slot 18 in the ratchet R. Coupled to a locking lever, not shown, the link 17 acts to shift the pin 10 between the unlocked position of FIG. 4, at the left hand extremity of the slot 18, and a locked position at the right hand extremity of the slot. The pin 10, when in the unlocked position, lies opposite to the pusher 9 of the release lever Re, allowing the transfer of the clockwise motion of the release lever to the ratchet R. When shifted to the locked position, however, the pin 10 does not receive the thrust of the release lever pusher 9, so that the latch system is locked against the manipulation of the outside and inside handles Ho and Hi.

For shifting the pin 10 between the locked and unlocked positions, the locking lever not shown is pivoted by another lever, also not shown, coupled to the link 4 leading to the sill knob N. This additional lever is mounted on the bracket 13 for pivotal motion in a plane normal to the plane of the latch member Lt. The locking lever, on the other hand, is mounted on the main body of the latch assembly L for pivotal motion in a plane parallel to the plane of the latch member Lt. It is thus seen that three-dimensional power transfer is also required between the two levers, as in the case of power transmission from the bell crank 12 to the release lever Re.

The three-dimensional power transfers explained in the foregoing unavoidably invite some play of the working parts and incur waste of mechanical energy. Such play of the working parts also gives the operator an uneasy sensation as he manipulates the inside handle and the knob. Further, the latch system as a whole becomes very complex in the arrangement of its components, which must be machined to close tolerances.

The latch system on each rear door Dr of the vehicle requires an additional consideration as its latch assembly L is often mounted as aforesaid in a slanting attitude as in FIGS. 1 and 3. Because of this slanting attitude, and of the restrictions in the relative placement of the latch assembly L and the outside handle Ho, the link 1 must be bent at two points, as seen in FIG. 1 and more clearly in FIGS. 3 and 4, as it extends between the outside handle and the release lever. The doubly bent link 1 does not, of course, effectively transmit power from the outside handle to the release lever. Only that component of the downward force of the link which is parallel to the plane of the release lever serves the purpose of causing the pivotal motion of the lever, the rest of the force being wasted.

The foregoing will have made clear that the prior art door latch system has several drawbacks in power transfer, especially when used on a back door. Particular attention is called to the unordered arrangement of the parts external to the main body of the latch assembly L.

How the present invention overcomes all these problems of the prior art will become apparent from the following description of the invention in terms of its two embodiments. FIGS. 5 to 12 illustrate one of the embodiments, which represents the most fundamental, preferable form of the door latch system of the invention.

Figure 5:
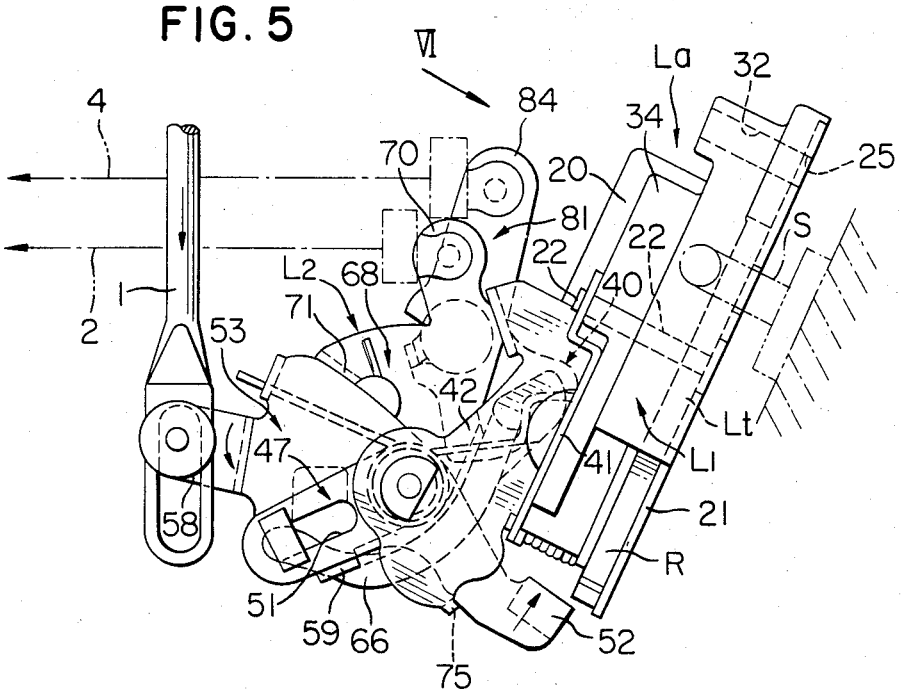
FIG. 5 is a view corresponding to FIG. 3 but showing essential parts of the door latch system embodying the principles of the present invention.
Figure 6:
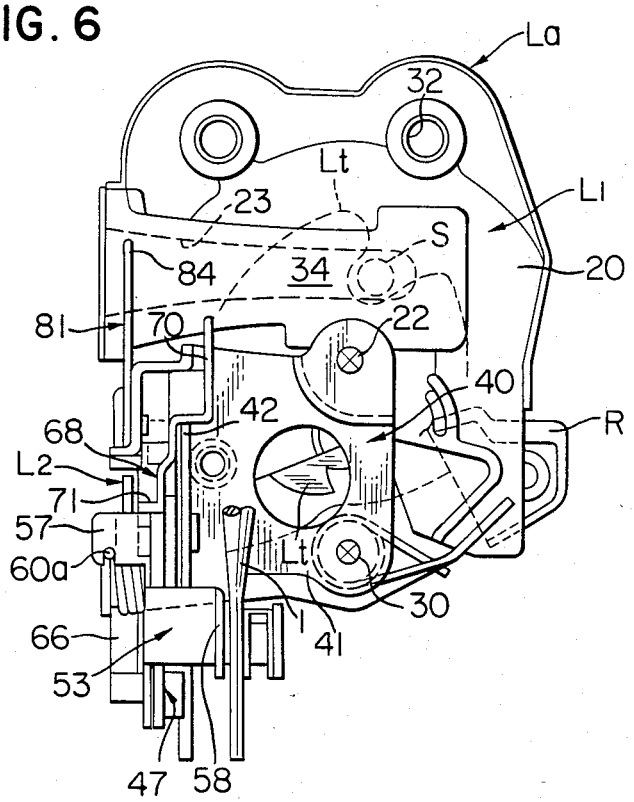
FIG. 6 is an elevation of the door latch system as seen in the direction of the arrow VI in FIG. 5.

Reference is first made to FIGS. 5 and 6. FIG. 5 is a view corresponding to FIG. 3, showing in particular the latch assembly La in accordance with the invention and the striker S. FIG. 6 shows the latch assembly La as seen in the direction of the arrow VI in FIG. 5. It will be observed from these figures that the latch assembly La has a main body or frame L1 carrying a control mechanism, generally designated 12, on its back. The main body L1 comprises a generally box-like back plate 20 of, normally, rigid synthetic resin material, and a metal-made faceplate 21. These back plate and faceplate are fastened to each other, and to the vehicle door, so as to form a housing for a latch member Lt and part of a ratchet R.

Figure 7:
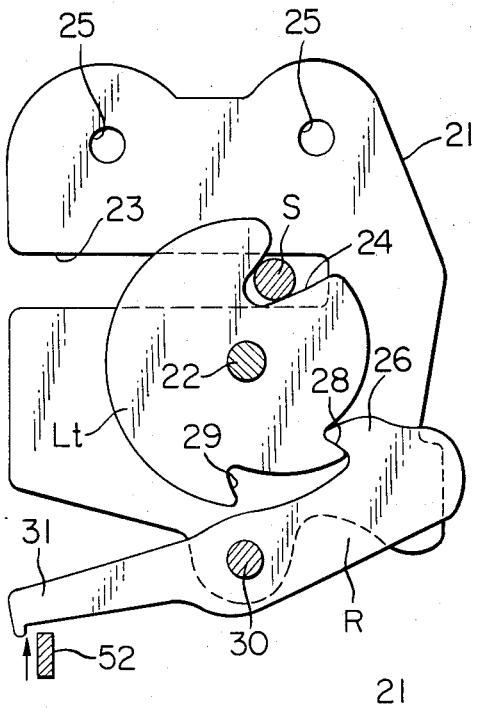
FIG. 7 shows in elevation only the latch member, ratchet, and faceplate of the latch assembly in accordance with the invention, the latch member being shown engaged by the ratchet in a fully latched position.
Figure 8:
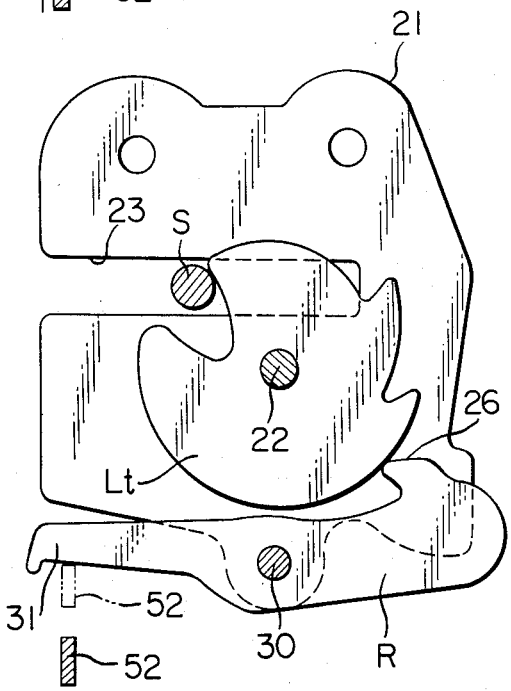
FIG. 8 is a view similar to FIG. 7 except that the latch member is shown disengaged from the ratchet.

FIGS. 7 and 8 better reveal the arrangement of the latch member Lt and the ratchet R in the main body L1. These figures show the latch assembly with its back plate and control mechanism removed from the state of FIG. 6. The latch member Lt is mounted approximately centrally on the faceplate 21 via a pivot pin 22 for rotation in sliding contact with the inside surface of the faceplate. The ratchet R is medially pivoted on the faceplate 21 via a pin 30. The latch member Lt and the ratchet R are in coplanar relation to each other. The faceplate 21 has formed therein a striker guideway 23 extending rectilinearly from one of its opposite sides, directed interiorly of the vehicle, and terminating short of the other side. Disposed across this striker guideway, the latch member Lt has a conventional recess 24 for engaging the striker S on the vehicle body when it is received in the guideway upon closure of the door.

In FIG. 7 is shown the striker S engaged by the latch member Lt in the fully latched position, with a pawl 26 of the ratchet R engaged in a notch 28 in the latch member. Thus engaged with the latch member, the ratchet R restrains its pivotal motion in a direction to release the striker, so that the vehicle door positively stays in the fully closed position relative to the vehicle body. The latch member Lt has formed therein a second notch 29, angularly spaced in a clockwise direction from the first recited notch 28, also to be engaged by the ratchet pawl 26. The latch system holds the door in a secondary latched position (i.e., a position less than fully closed) upon engagement of the ratchet pawl 26 in the second notch 29 in the latch member.

The pawl 26 at one end of the ratchet R disengages the latch member Lt when the ratchet is pivoted clockwise, as viewed in FIGS. 7 and 8, by receiving a thrust to an abutment 31 at its other end, as indicated by the arrow in FIG. 7. The latch member is urged by a spring to turn in the counterclockwise direction, as has been known heretofore. Consequently, when disengaged from the ratchet, the latch member pivots as in FIG. 8 to release the striker. The door can now be opened.

As the back plate 20 is placed over the faceplate 21 of FIGS. 7 and 8 to form the main body L1 as in FIGS. 5 and 6, the latch member Lt becomes completely enclosed therein whereas the ratchet R remains largely exposed. The faceplate 21 has a pair of holes 25 formed therein in register with a pair of holes 32 in the back plate 20. These holes 25 and 32 pass fastener elements therethrough in mounting the latch assembly La to the door structure. At 34 in FIGS. 5 and 6 is seen a rearward protuberance of the back plate 20 extending along the striker guideway 23 in the faceplate 21 to provide an internal space for the passage of the striker S.

It will be seen from the foregoing description of FIGS. 7 and 8 in particular that the main body L1 of the latch assembly accommodates only the latch member Lt and the ratchet R. All of the members of the control mechanism 12 for the latch assembly are mounted external to the main body, as will be seen from FIGS. 5 and 6 as well as from FIG. 9. The latter figure reveals at 45 a torsion spring coiled around the pivot pin 30 of the ratchet R to bias the same in the direction to engage the latch member Lt.

Figure 9:
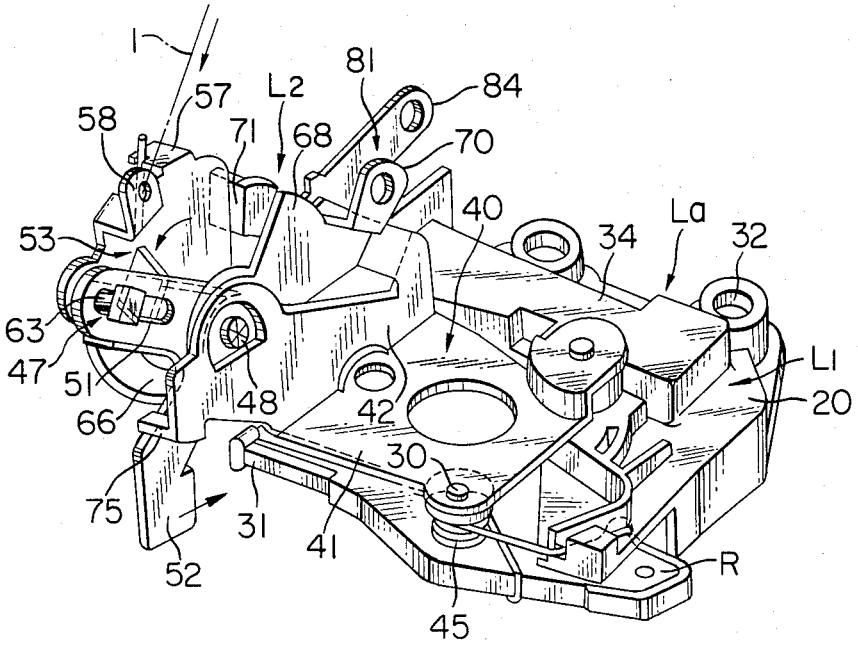
FIG. 9 is a view in perspective of the essential parts of the door latch system shown in FIGS. 5 and 6.
Figure 10:
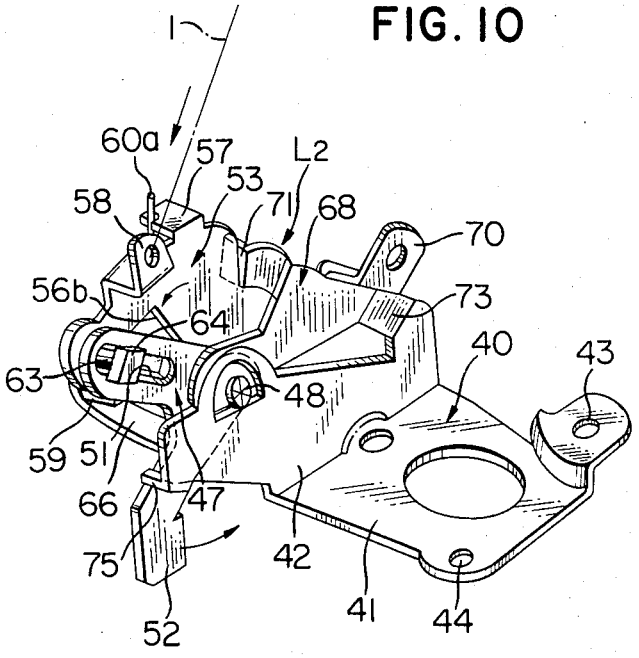
FIG. 10 is a view in perspective of the latch controls seen also in FIGS. 5, 6 and 7, with certain parts of the latch controls being removed to clearly reveal other parts.
Figures 11, 12:
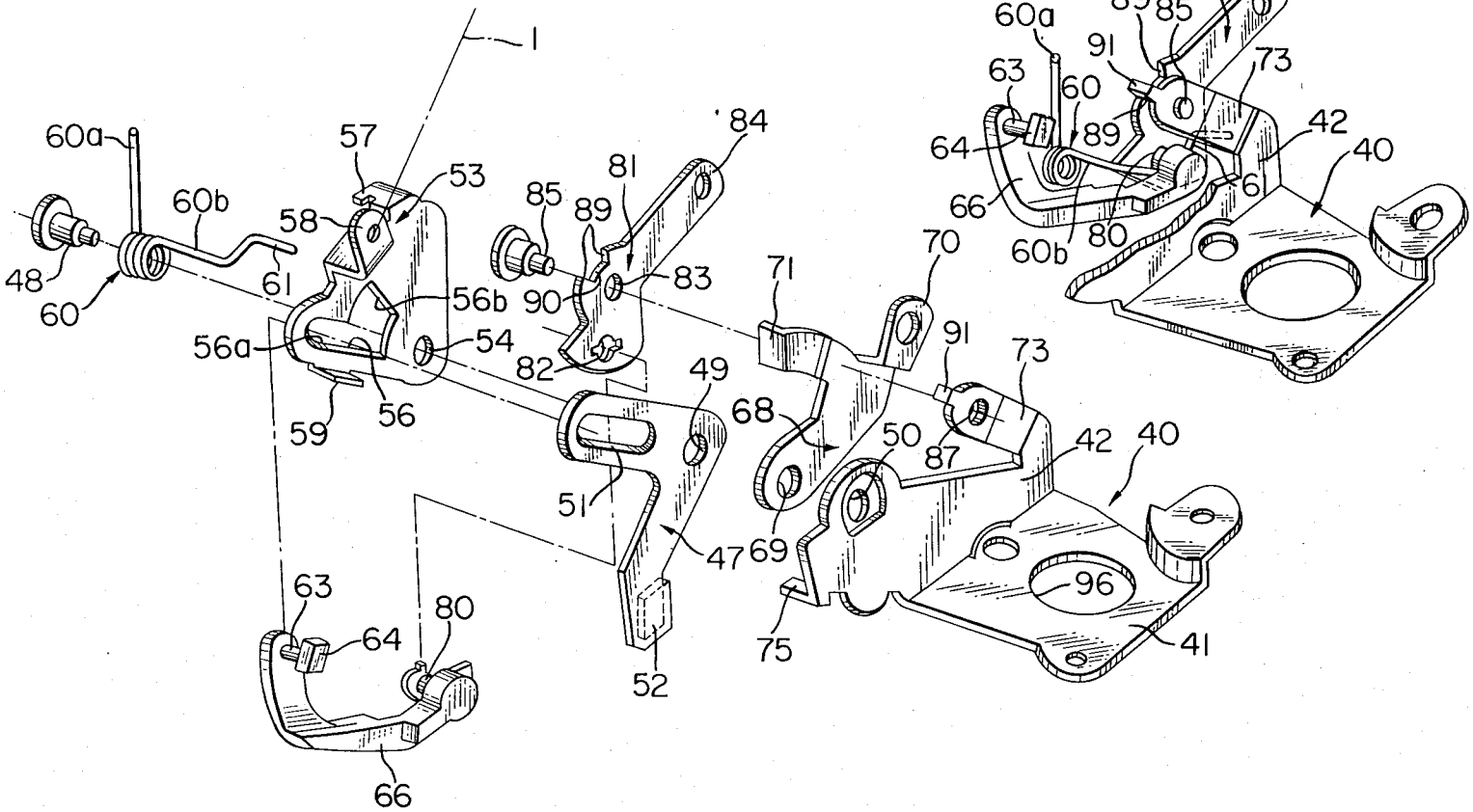
FIG. 11 is an exploded perspective view of the complete latch controls.
FIG. 12 is a view in perspective, partly broken away for clarity, of only the locking mechanism of the latch controls, the other parts of the latch controls being removed for illustrative convenience.

Although the latch control mechanism L2 appears fully in FIGS. 5 and 6, FIGS. 9 to 12 better illustrate them in perspective. With reference directed principally to FIGS. 9, 10 and 11 the reference numeral 40 generally denotes a bracket for supporting the latch control mechanism L2 on the main body L1. The bracket 40 integrally comprises a base portion 41 held flat against the back plate 20 of the main body L1, and an upstanding portion 42 at right angles with the base portion. It is to be noted that the upstanding bracket portion 42 is perpendicular to the plane of the latch member Lt and the ratchet R in the main body L1. The base portion 41 of the bracket 40 has formed therein two mounting holes 43 and 44 through which pass the pivot pins 22 and 30, respectively, of the latch member and the ratchet. The bracket is retained in position on the main body L1 by pressing down the ends of the pivot pins 22 and 30 protruding out of the holes 43 and 44.

Mounted on the upstanding bracket portion 42 for pivotal motion about a common pin 48 are an actuating lever 47, an outside release lever 53, and an inside release lever 68. Being the most fundamental constituents of the latch control mechanism L2, these three levers will hereinafter be described one by one as to their constructions and operations.

The actuating lever 47 takes the form of a bell crank, having a bore 49 at the junction of its two arms. The pivot pin 48 extends through this bore 49 and a bore 50 in the upstanding bracket portion 42. One of the arms of the actuating lever 47 has a slot 51 formed longitudinally therein, whereas the other arm terminates in a pusher 52. As shown in FIG. 9, as well as in FIGS. 7 and 8, the pusher 52 of the actuating lever 47 lies opposite to the abutment 31 of the ratchet R for movement into and out of abutting engagement therewith. Upon pivotal motion of the actuating lever 47 in the counterclockwise direction, as seen in FIGS. 9 to 12, its pusher 52 engages the abutment 31 of the ratchet and turns the same in the direction to disengage the latch member Lt as in FIG. 8.

For causing the counterclockwise turn of the actuating lever 47 in response to the activation of the outside handle Ho (FIG. 1), there is provided the outside release lever 53 best pictured in FIG. 11. Generally of approximately triangular shape, the outside release lever 53 has a bore 54 adjacent one of its apexes. The pivot pin 48 is passed through the bore 54. The outside release lever 53 has formed therein an opening 56 adjacent one side, directed to the left in FIGS. 9 to 11. The opening 56 includes a slot 56*a* extending radially with respect to the pivotal motion of the lever, and a lateral expansion 56*b* at the inner end of the slot.

Formed at the outer edge of the outside release lever 53 are a spring retainer 57 and an L-shaped lug 58. As best seen in FIG. 5, the lug 58 is pin-jointed to the link 1 leading to the outside handle Ho of FIG. 1. The pin joint is such that the link 1 has a preassigned play in its longitudinal direciton. The spring retainer 57 engages one end 60*a* of a coil torsion spring 60 disposed around the pivot pin 48, as will be seen from FIG. 11. The other end 60*b* of this torsion spring is held against a part hereinafter described, with the result that the spring biases the outside release lever 53 in the clockwise direction about the pivot pin 48. The end 60*b* of the torsion spring is bent into the shape of an inverted V, as identified by the reference numeral 61, for a purpose to be described later. The outside release lever 53 has also an abutment 59 formed on one of its sides. Normally held against the slotted arm of the actuating lever 47, the abutment 59 serves to normally maintain the actuating lever in a prescribed angular position relative to the outside release lever 53 as in FIGS. 9 and 10.

The slot 51 in the actuating lever 47 and the slot 56*a* in the outside release lever 53 are of approximately the same shape and size and in register with each other when the two levers are in the illustrated normal angular positions. Slidably extending through these slots 51 and 56*a* are a pin 63 for imparting, as required, the pivotal motion of the outside release lever 53 to the actuating lever 47. The pin 63 is affixed to one end of a link 66 forming a part of a locking mechanism and has a head 64 thereby to be held engaged in the slots. The link 66 with the headed pin 63 can be a synthetic resin molding.

The locking mechanism including the link 66 will be described in detail later. Suffice it to say for the moment that the locking mechanism acts to shift the pin 63 between an unlocked position of FIGS. 9 and 10, where the pin lies at that extremity of the registered slots 51 and 56*a* which is away from the lateral expansion 56*b* of the slot 56*a*, and a locked position at the other extremity of the slots.

The latch control mechanism so far described, notably including the actuating lever 47 and the outside release lever 53, operates to unlatch the door in response to the manipulation of the outside handle Ho, in the following manner. Upon actuation of the outside handle the link 1 descends as indicated by the arrow in FIGS. 5, 9 and 10. The descending link 1 causes the outside release lever 53 to pivot counterclockwise about the pin 48 against the bias of the torsion spring 60. If then the pin 63 is in the unlocked position of FIGS. 9 and 10, this pin transmits the pivotal motion of the outside release lever 53 to the actuating lever 47. Thus, the actuating lever 47 is turned counterclockwise, and the pusher 52 thereof is moved into abutting contact with the abutment 31 of the ratchet R as in FIG. 7. The pusher 52 further pushes the abutment 31 as in FIG. 8 thereby pivoting the ratchet R out of engagement with the latch member Lt. The latch member is now free to revolve in the direction to release the striker S, so that the door is openable.

The last of the aforementioned three levers, the inside release lever 68 functions, as the name implies, to cause the ratchet R to release the latch member Lt via the levers 47 and 53 in response to the manipulation of the inside handle Hi. FIG. 11 best illustrates the shape of the inside release lever 68. A bore 69 in this lever receives the pivot pin 48. It may be mentioned here that the coaxial mounting of the actuating lever 47, outside release lever 53 and inside release lever 68 on the pivot pin 48 serves to materially simplify the arrangement of the latch control mechanism and contributes to the ease of manufacture or assemblage thereof. Being in side-by-side relation, the three levers 47, 53 and 68 pivot in planes parallel to the upstanding bracket portion 42 and normal to the plane of the latch member and the ratchet.

At the free end of the inside release lever 68 there are formed a bored lug 70 for connection to the link 2 (FIG. 5) leading to the inside handle Hi and an abutment 71 bent right-angularly from the lever plane. The lug 70 is pin-jointed to the link 2 as in FIG. 5, so that the actuation of the inside handle Hi results in a pivotal motion of the inside release lever in the counterclockwise direction. The abutment 71 is normally held against one side of the outside release lever 53 as in FIGS. 9 and 10. As shown also in FIGS. 9 and 10, the inside release lever 68 has one of its sides, away from the outside release lever 53, normally held against a stop 73 formed by an extension of the upstanding bracket portion 42 bent perpendicularly therefrom.

It has been stated that the outside release lever 53 is biased by the torsion spring 60 in the clockwise direction. Being normally in contact with the abutment 71 of the inside release lever 68, the outside release lever 53 urges the inside release lever in the same direction. The consequent clockwise revolution of the inside release lever is limited by the stop 73 integral with the upstanding bracket portion 42.

The torsion spring 60 also acts on the actuating lever 47 via the abutment 59 of the outside release lever 53. A stop 75 integral with the upstanding bracket portion 42 limits the clockwise turn of the actuating lever 47. Were it not for this stop, the actuating lever might pivot clockwise from the position of FIGS. 9 and 10 when the pin 63 was shifted to the locked position.

The following is a description of the operation of the latch control mechanism L2 in response to the manipulation of the inside handle Hi. When turned, the inside handle exerts a leftward pull on the link 2, as seen in FIG. 5. The result is the counterclockwise turn of the inside release lever 68 about the pivot pin 48 against the force of the torsion spring 60. The counterclockwise turn of the inside release lever 68 is directly imparted to the outside release lever 53 via the abutment 71 of the former. If then the pin 63 is in the unlocked position of FIGS. 9 and 10, the actuating lever 47 is also pivoted in the same direction through the pin. Thus the actuating lever disengages the ratchet R from the latch member Lt, just as it does upon actuation of the outside handle Ho. Disengaged from the ratchet, the latch member releases the striker S.

So far the discussion has concerned the manner in which the latch control mechanism L2 acts on the ratchet R to cause the latch member Lt to release the striker S in response to the manipulation of the outside handle Ho or inside handle Hi on the vehicle door. The handles Ho and Hi are linked to the outside release lever 53 and to the inside release lever 68, respectively, causing the levers to pivot the ratchet actuating lever 47 in the direction to unlatch the door. It will be seen, then, that the door can be locked against actuation by both handles Ho and Hi if the actuating lever 47 is held stationary in spite of the pivotal motion of either of the outside and inside release levers. This is exactly what is done by the locking mechanism hereinafter describ- ed.

As has been mentioned, the locking mechanism includes the link 66 carrying the headed pin 63 which extends through the slot 51 in the actuating lever 47 and the opening 56 in the outside release lever 53. When in the position of FIGS. 9 and 10, the pin 63 transmits the counterclockwise motion of the outside release lever 53, and of the inside release lever 68, to the actuating lever 47 thereby causing the same to act on the ratchet R for unlatching the door. When shifted to the other extremity of the registered slots 51 and **56*a*, the pin 63 becomes free to enter the lateral expansion 56*b* of the slot 56*a*. If then the outside release lever 53 is pivoted counterclockwise, either directly by the outside handle or indirectly by the inside handle through the inside release lever 68, the pin 63 just enters the lateral expansion 56*b* of the slot 56*a* and so does not impart the pivotal motion of the outside release lever to the actuating lever 47**. Thus the vehicle door remains latched, or locked, against actuation by both the outside handle Ho and the inside Hi handle.

The locking mechanism for shifting the pin 63 between the locked and unlocked positions is shown in a disassembled state in FIG. 11 and in assembled form in FIG. 12. Lying just behind the outside release lever 53 as in FIG. 6, the link 66 of the locking mechanism has the pin 63 on one end and a pivot pin 80 on the other end. The pivot pin 80 is rotatably received in a hole 82 at one end of a locking lever 81, another important component of the locking mechanism.

The locking lever 81 has a bore 83 formed medially therein to receive a pivot pin 85. The other end 84 of the locking lever is adapted for pivotal connection to the link 4 (FIG. 5) leading to the sill knob N of FIG. 1. The pivot pin 85 is inserted into and through the bore 83 in the locking lever 81 and a bore 87 in a lug bent perpendicularly from the stop 73 integral with the upstanding bracket portion 42. One end of the pivot pin 85 has a preformed head, and its other end, projecting out of the bore 87, is pressed down to form a second head. Thus is the locking lever 81 medially pivoted on the upstanding bracket portion 42 for pivotal motion in a plane parallel to the planes of the other levers 47, 53 and 68.

The locking lever 81 has a recess 90 formed therein in the vicinity of its pivot. A pair of abutments 89 bound the opposite extremities of the recess 90. Slidably engaged in the recess 90 is a projection 91 from the bored lug of the upstanding bracket portion 42. The projection 91 coacts with the pair of abutments 89 to determine the angle through which the locking lever 81 pivots in response to the manipulation of the sill knob N.

FIG. 12 clearly shows that the end **60*b* of the torsion spring 60, having the inverted V-shaped bend 61, underlies the pin 80 pivotally interconnecting the link 66 and the locking lever 81. The spring end 60*b* is held against the pin 80. Consequently, with the pivotal motion of the locking lever 81 between the two extreme positions set forth previously, the pin 80 rides over the bend 61 of the torsion spring 60. This serves to positively maintain the locking lever 81**, and the other working parts of the locking mechanism, in either of the two positions.

In the operation of the locking mechanism, the locking lever 81 is shown in the unlocked position in FIGS.

5, 9, 10 and 12. The pin 63 is in the position of FIGS. 9 and 10, ready to transfer the pivotal motion of the outside release lever 53 to the actuating lever 47.

For locking the vehicle door the operator pushes down the sill knob N. So actuated, the sill knob causes the locking lever 81 to turn counterclockwise via the bell crank 3 and the link 4. The counterclockwise motion of the locking lever 81 is translated into the approximately longitudinal, rightward displacement of the link 66, with the result that the pin 63 is shifted from the unlocked to the locked position in the registered slots 51 and 56*a*. The door is now locked and not openable by either the outside or inside handle as long as the sill knob remains depressed.

Figure 13:
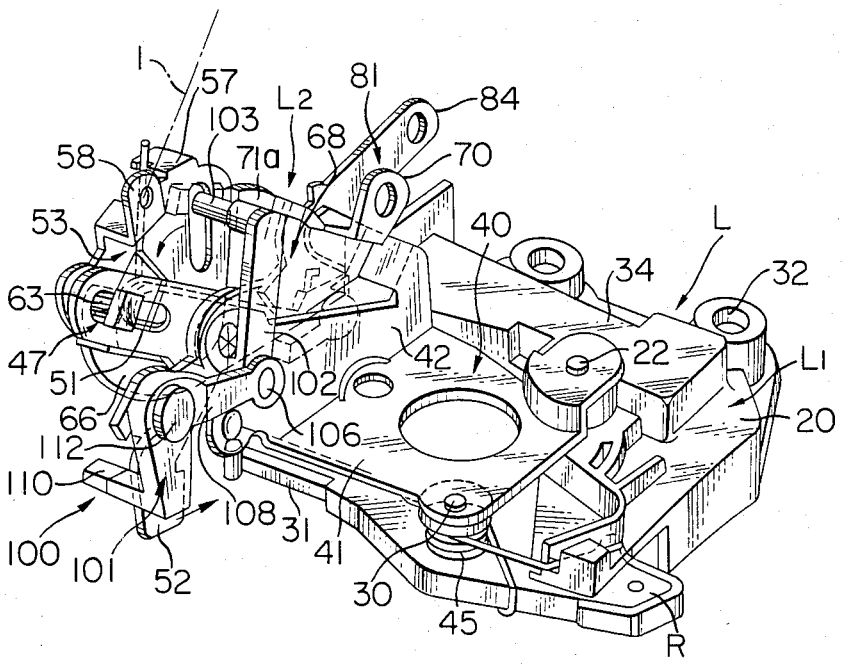
FIG. 13 is a view corresponding to FIG. 9 but showing another preferred embodiment of the invention incorporating the childproofing mechanism.
Figure 14:
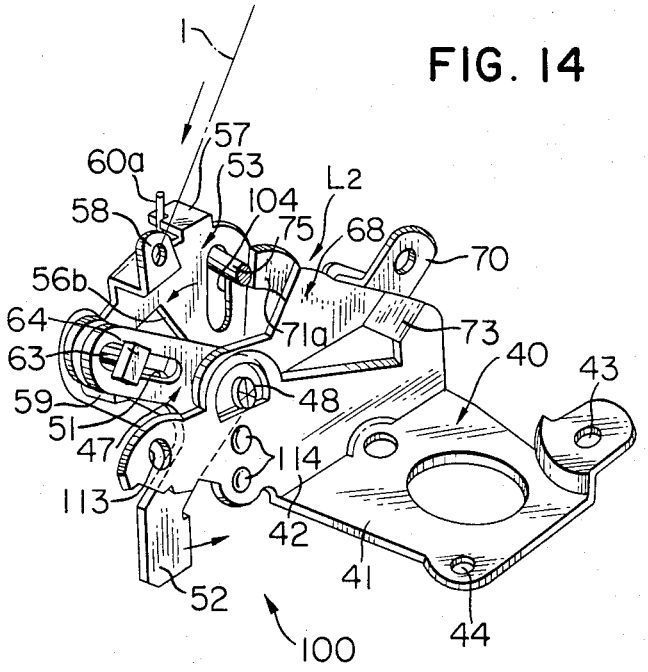
FIG. 14 is a view in perspective of the latch controls in the embodiment of FIG. 13, with certain parts of the childproofing mechanism being removed to clearly reveal other parts.
Figure 15:
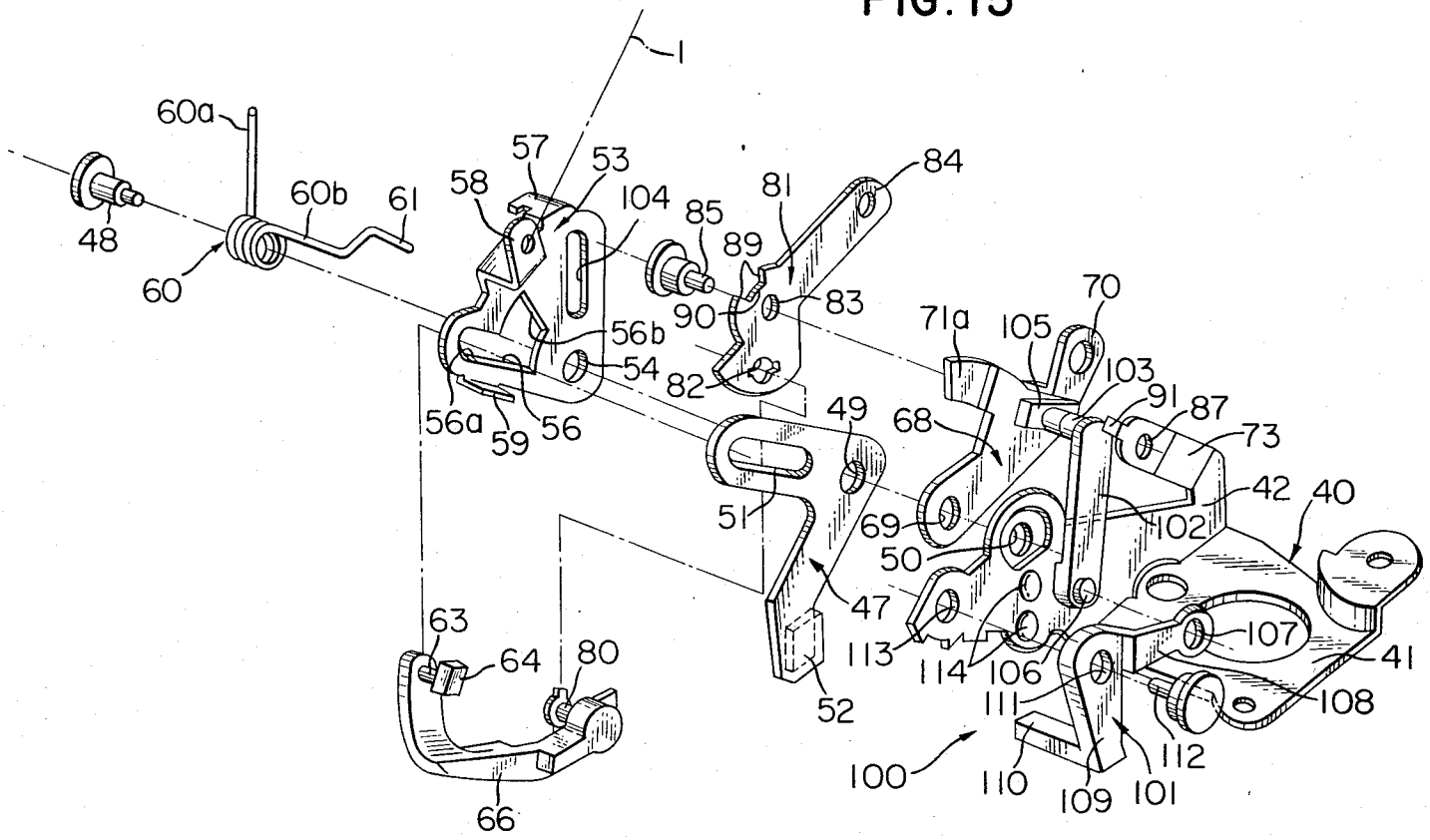
FIG. 15 is an exploded perspective view of the latch controls in the embodiment of FIG. 13.

FIGS. 13, 14 and 15 illustrate another preferred embodiment of the invention, additionally comprising a mechanism for making the latch system childproof. As has been explained, the locking mechanism locks the door by making the actuating lever 47 unresponsive to the pivotal motions of both the outside and inside release levers 53 and 68. The childproofing mechanism, on the other hand, functions to make the actuating lever unresponsive only to the pivotal motion of the inside release lever 68, that is, to any unintended activation of the inside handle.

Generally labeled 100 in FIGS. 13, 14 and 15, the childproofing mechanism broadly comprises a hand lever 101 pivotally mounted on the upstanding bracket portion 42, and a link 102 pivotally coupled at one end to the hand lever 101 and carrying a headed pin 103 on the other end. The pin 103 is slidably engaged in an additional slot 104 formed in the outside release lever 53 and is restrained from disengagement therefrom by its head or enlargement 105. The slot 104 extends radially of the outside release lever 53 with respect to its pivotal motion. The hand lever 101 coacts with the link 102 to move the pin 103 between the opposite extremities of the slot 104.

When in the upper end position, as seen in these figures, of the slot 104, away from the pivot of the outside release lever 53, the pin 103 normally contacts an abutment 71*a* integral with the inside release lever 68. As has been stated in connection with the preceding embodiment, the torsion spring 60 biases the outside release lever 53 in the clockwise direction. Accordingly, when in the illustrated position, the pin 103 urges the inside release lever 68 in the same direction, until the latter comes to rest on the stop 73 integral with the upstanding bracket portion 42. Also, upon pivotal motion of the inside release lever 68 in the counterclockwise direction in response to the manipulation of the inside handle, the pin 103 functions to impart this motion to the outside release lever 53 and thence, if the pin 63 of the locking mechanism is in the illustrated unlocked position, to the actuating lever 47.

The childproofing mechanism 100 is therefore inactive when the pin 103 is in the illustrated upper end position of the slot 104. It will be seen, then, that the latch system is rendered childproof as the pin 103 is shifted to the lower end position of the slot 104. In this second position the pin 103 does not transmit the counterclockwise motion of the inside release lever 68 to the outside release lever 53, the pin being then out of the path of the inside release lever abutment 71*a*. The door becomes unopenable by the inside handle, even if not locked by the locking mechanism set forth in conjunction with the preceding embodiment.

The link 102 of the childproofing mechanism 100 has a stud 106 on its end away from the pin 103, to be rotatably fitted in a bore 107 in the hand lever 101. The link 102 together with its pin 103 and stud 106 can be an integral molding of synthetic resin material. The hand lever 101 takes the form of a bell crank, comprising a first arm 108 having the bore 107 at its free end and a second arm 109 terminating in an offset crank arm 110. At the junction of the two angled arms 108 and 109, there is formed a bore 111 for receiving a headed pivot pin 112. Further engaged in a bore 113 in the upstanding bracket portion 42, the pivot pin 112 makes it possible for the hand lever 101 to pivot in a plane parallel to the planes of the levers 47, 53 and 68.

In order to firmly retain the hand lever 101, and the other working parts of the childproofing mechanism 100, in either of the two desired positions, the link 102 has a hemispherical projection, not seen, formed at its lower end and on its surface opposite to the one on which the pin 106 is formed. The unseen projection is resiliently engageable in either of a pair of depressions 114 of corresponding shape and size formed in the opposed surface of the upstanding bracket portion 42 in positions spaced equidistantly from the pivot 112 of the hand lever 101. Being molded of synthetic resin material as aforesaid, the link 102 as well as its projection undergoes some elastic deformation as the projection moves into and out of engagement with the depressions 114. Once the projection is engaged in either depression, moreover, it stays positively engaged to hold the working parts of the childproofing mechanism in the desired position.

When the latch assembly of FIGS. 13 to 15 is mounted in position on the vehicle door, the crank arm 110 of the hand lever 101 partly projects inwardly of the door, in a position where it cannot be tampered with by children. An adult rider of the vehicle may turn, as required, the hand lever 101 in a clockwise direction, as seen in the figures, until the unseen projection of the link 102 becomes received in the lower one of the depressions 114. The clockwise motion of the hand lever 101 causes the link 102 to shift the pin to the lower end position of the slot 104. The latch system is now childproof.

What is claimed is:

1. An automotive door latch system operable by both outside and inside handles on a vehicle door, comprising:

(a) a striker attached to a vehicle body;

(b) a main body attached to the vehicle door, the main body having a guideway for receiving the striker when the vehicle door is in a closed position relative to the vehicle body;

(c) a latch member movably mounted in the main body and adapted to engage the striker in the guideway for holding the vehicle door in the closed position;

(d) a ratchet engageable with the latch member to inhibit its motion in a direction to disengage the striker, the latch member and the ratchet being disposed in coplanar relation to each other and being the sole members mounted in the main body;

(e) a bracket formed in rigid relation to the main body and having at least a portion upstanding on the outside of the main body, the upstanding portion of the bracket being oriented normal to the plane of the latch member and the ratchet; and (f) lever means mounted on the upstanding portion of the bracket for pivotal motion in a plane parallel to the upstanding portion, said lever means comprising:

(1) an actuating lever mounted on a pivot for acting directly on the ratchet to cause the same to disengage the latch member;

(2) an outside release lever mounted on said pivot and operatively linked to the outside handle to be pivoted thereby;

(3) an inside release lever mounted on said pivot and operatively linked to the inside handle to be pivoted thereby, the inside release lever being normally in abutting contact with the outside release lever to cause pivotal motion thereof in response to the actuation of the inside handle whereby the outside release lever is pivoted in the same direction upon actuation of the outside handle and of the inside handle; and (4) means for transmitting the pivotal motion of the outside release lever to the actuating lever to cause the latter to act on the ratchet.

2. The automotive door latch system as recited in claim 1, wherein the transmitting means of the lever means comprises:

(a) a pin extending between the outside release lever and the actuating lever; and (b) a locking mechanism for shifting the pin between an unlocked position, where the pin transmits the pivotal motion of the outside release lever to the actuating lever, and a locked position where the pin does not transmit the pivotal motion of the outside release lever to the actuating lever.

3. The automotive door latch system as recited in claim 2, wherein the pin extends through a slot in the outside release lever and another slot in the actuating lever, the two slots being normally in register with each other, the slot in the outside release lever having a lateral expansion at one end for preventing the pin from transmitting the pivotal motion of the outside release lever to the actuating lever, and wherein the locking mechanism shifts the pin between the opposite extremities of the two slots.

4. The automotive door latch system as recited in claim 3, wherein the locking mechanism comprises:

(a) a locking lever to be actuated manually; and (b) a link pivotally coupled at one end to the locking lever and carrying the pin on the other end.

5. The automotive door latch system as recited in claim 1, wherein the ratchet is urged by a spring to move toward a position of engagement with the latch, and wherein the actuating lever is adapted to move into and out of abutting engagement with the ratchet.

6. The automotive door latch system as recited in claim 1, further comprising a childproofing mechanism for preventing the vehicle door from being opened accidentally by a child tampering with the inside handle, the childproofing mechanism being effective, when actuated, to prevent the pivotal motion of the inside release lever from being imparted to the outside release lever.

7. The automotive door latch system as recited in claim 6, wherein the childproofing mechanism comprises:

(a) a pin coupled to the outside release lever for movement relative to the same between a first position, where the inside release lever is normally in abutting contact with the pin to impart pivotal motion to the outside release lever, and a second position where the inside release lever is incapable of abutting contact with the pin; and (b) means for moving the pin between the first and the second positions.

8. The automotive door latch system as recited in claim 7, wherein the pin of the childproofing mechanism is slidably engaged in a slot formed in the outside release lever, and wherein the pin moving means comprises:

(a) a hand lever pivotally mounted on the bracket for manual actuation; and (b) a link pivotally coupled at one end to the hand lever and carrying the pin on the other end.

* * * * *